US009557080B2

(12) United States Patent
Matsuura et al.

(10) Patent No.: US 9,557,080 B2
(45) Date of Patent: Jan. 31, 2017

(54) REFRIGERATION CYCLE APPARATUS

(71) Applicant: Panasonic Corporation, Kadoma-shi, Osaka (JP)

(72) Inventors: Takahiro Matsuura, Osaka (JP); Tomoichiro Tamura, Osaka (JP); Bunki Kawano, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 389 days.

(21) Appl. No.: 14/003,984

(22) PCT Filed: Jan. 18, 2013

(86) PCT No.: PCT/JP2013/000239
§ 371 (c)(1),
(2) Date: Sep. 9, 2013

(87) PCT Pub. No.: WO2013/108636
PCT Pub. Date: Jul. 25, 2013

(65) Prior Publication Data

US 2014/0053597 A1 Feb. 27, 2014

(30) Foreign Application Priority Data

Jan. 18, 2012 (JP) ..... 2012-008223

(51) Int. Cl.
*F25B 1/10* (2006.01)
*F25B 41/00* (2006.01)
(Continued)

(52) U.S. Cl.
CPC . *F25B 1/10* (2013.01); *F25B 1/00* (2013.01); *F25B 41/003* (2013.01); *F25B 41/04* (2013.01);
(Continued)

(58) Field of Classification Search
CPC ..... F25B 1/10; F25B 2400/072; F25B 41/04; F25B 41/003; F25B 2400/13
(Continued)

(56) References Cited

U.S. PATENT DOCUMENTS 4,910,972 A * 3/1990 Jaster ..... F25B 1/10 62/335
2011/0036110 A1 2/2011 Fujimoto et al.
2013/0014537 A1 1/2013 Fujisawa et al.

FOREIGN PATENT DOCUMENTS

CN 102016449 4/2011
JP 06-257890 9/1994
(Continued)

OTHER PUBLICATIONS

Office Action issued in corresponding Chinese Application No. 201380000871.0, Jun. 11, 2015, 3 pages.

*Primary Examiner* — Allen Flanigan
*Assistant Examiner* — Filip Zec
(74) *Attorney, Agent, or Firm* — Hamre, Schumann, Mueller & Larson, P.C.

(57) ABSTRACT

A refrigeration cycle apparatus (1A) includes: a main circuit (2) composed of an evaporator (25), a first compressor (21), an intercooler (8), a second compressor (22), and a condenser (23) which are connected in this order; and an evaporation-side circulation path (5) that allows a refrigerant liquid retained in the evaporator (25) to circulate via a heat exchanger for heat absorption (6). The intercooler (8) is a heat exchanger that allows a refrigerant vapor compressed by the first compressor (21) to be cooled by the refrigerant liquid. A supply path (71) supplies, to the intercooler (8), a portion of the refrigerant liquid flowing in the first circulation path (5), and a recovery path (73) recovers the refrigerant liquid from the intercooler (8) to the evaporator (25).

16 Claims, 4 Drawing Sheets

(51) Int. Cl.
*F25B 1/00* (2006.01)
*F25B 41/04* (2006.01)

(52) U.S. Cl.
CPC ..... *F25B 2400/072* (2013.01); *F25B 2400/13* (2013.01)

(58) Field of Classification Search
USPC ..... 62/510, 513
See application file for complete search history.

(56) References Cited

FOREIGN PATENT DOCUMENTS

| | | |
|---|---|---|
| JP | 2008-122012 | 5/2008 |
| JP | 2008-209096 | 9/2008 |
| JP | 2009-115379 | 5/2009 |
| JP | 2010-230265 | 10/2010 |
| JP | 2011-196185 | 10/2011 |
| WO | 2009/121548 | 10/2009 |

* cited by examiner

REFRIGERATION CYCLE APPARATUS

TECHNICAL FIELD

The present invention relates to a refrigeration cycle apparatus.

BACKGROUND ART

Conventionally, refrigeration cycle apparatuses in which a chlorofluorocarbon or an alternative chlorofluorocarbon is used as a refrigerant are widely used. However, such refrigerants are responsible for the problems such as ozone depletion and global warming. In view of this, refrigeration cycle apparatuses have been proposed in which water is used as a refrigerant that places only an extremely small load on the global environment. As an example of such a refrigeration cycle apparatus, Patent Literature 1 discloses an air conditioner specialized for cooling.

When water is used as a refrigerant, a large amount of refrigerant vapor needs to be compressed at a high compression ratio. Accordingly, the air conditioner disclosed in Patent Literature 1 uses two compressors, i.e., a centrifugal compressor and a positive-displacement compressor, and the compressors are arranged in series so that a refrigerant vapor compressed by the centrifugal compressor is further compressed by the positive-displacement compressor.

In addition, when water is used as a refrigerant, the temperature of the refrigerant discharged from a compressor is high due to the physical properties of water. Therefore, the durability of members constituting a high-pressure part of the air conditioner is reduced. In order to address this problem, it is effective to dispose an intercooler between the upstream-side compressor and the downstream-side compressor as in the air conditioner disclosed in Patent Literature 1, and thus to temporarily reduce the temperature of the refrigerant vapor in the course of compression process.

CITATION LIST

Patent Literature

Patent Literature 1: JP 2008-122012 A

SUMMARY OF INVENTION

Technical Problem

The present disclosure aims to provide a refrigeration cycle apparatus that includes an intercooler having a high heat-exchange efficiency and that uses a refrigerant, such as water, whose saturated vapor pressure is a negative pressure at ordinary temperature (20° C.±15° C.: Japanese Industrial Standards (JIS) Z 8703).

Solution to Problem

The present disclosure provides a refrigeration cycle apparatus including: a main circuit that allows a refrigerant whose saturated vapor pressure is a negative pressure at ordinary temperature to circulate, the main circuit including an evaporator that retains a refrigerant, liquid and that evaporates the refrigerant liquid therein, a first compressor that compresses a refrigerant vapor, an intercooler that cools the refrigerant vapor, a second compressor that compresses the refrigerant vapor, and a condenser that condenses the refrigerant vapor therein and that retains the refrigerant liquid, wherein the evaporator, the first compressor, the intercooler, the second compressor, and the condenser are connected in this order; and an evaporation-side circulation path that allows the refrigerant liquid retained in the evaporator to circulate via a heat exchanger for heat absorption. The intercooler is a heat exchanger that allows the refrigerant vapor compressed by the first compressor to be cooled by the refrigerant liquid. The refrigeration cycle apparatus further includes: a supply path that supplies, to the intercooler, a potion of the refrigerant liquid flowing in the evaporation-side circulation path; and a recovery path that recovers the refrigerant liquid from the intercooler to the evaporator.

Advantageous Effects of Invention

According to the present disclosure, a refrigeration cycle apparatus including an intercooler having high heat exchange-efficiency can be provided.

DESCRIPTION OF EMBODIMENTS

Figure 1:
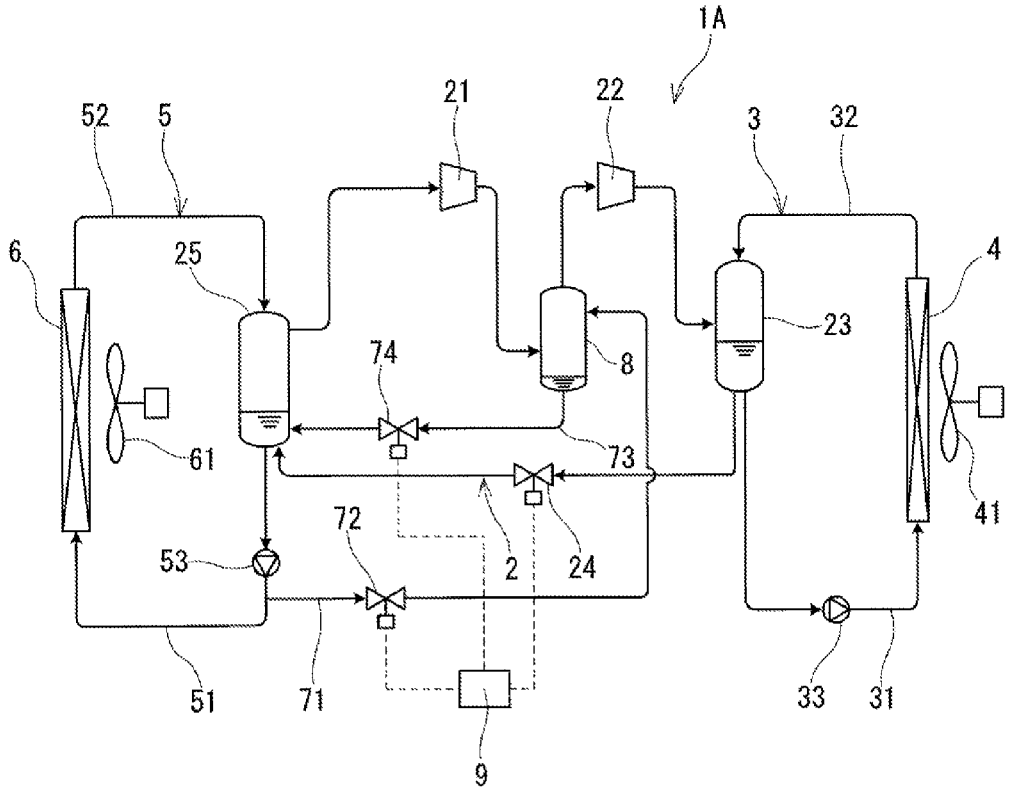
FIG. 1 is a configuration diagram of a refrigeration cycle apparatus according to one embodiment of the present disclosure.

A first aspect of the present disclosure provides a refrigeration cycle apparatus including: a main circuit that allows a refrigerant whose saturated vapor pressure is a negative pressure at ordinary temperature to circulate, the main circuit including an evaporator that retains a refrigerant liquid and that evaporates the refrigerant liquid therein, a first compressor that compresses a refrigerant vapor, an intercooler that cools the refrigerant vapor, a second compressor that compresses the refrigerant vapor, and a condenser that condenses the refrigerant vapor therein and that retains the refrigerant liquid, wherein the evaporator, the first compressor, the intercooler, the second compressor, and the condenser are connected in this order; and an evaporation-side circulation path that allows the refrigerant liquid retained in the evaporator to circulate via a heat exchanger for heat absorption. The intercooler is a heat exchanger that allows the refrigerant vapor compressed by the first compressor to be cooled by the refrigerant liquid. The refrigeration cycle apparatus further includes: a supply path that supplies, to the intercooler, a potion of the refrigerant liquid flowing in the evaporation-side circulation path; and a recovery path that recovers the refrigerant liquid from the intercooler to the evaporator.

According to the first aspect, the refrigerant, liquid circulating in the refrigeration cycle apparatus has a relatively low temperature when flowing in the evaporation-side circulation path. Since the refrigerant liquid having a relatively low temperature is supplied to the intercooler, the temperature difference between the fluid used for cooling and the refrigerant vapor to be cooled is large. Therefore, the amount of heat exchanged per predetermined heat-transfer area in the intercooler is large. Consequently the heat-exchange efficiency of the intercooler is high.

A second aspect of the present disclosure provides the refrigeration cycle apparatus as set forth in the first aspect, wherein the evaporation-side circulation path includes: a feed path that is provided with a pump and that directs the refrigerant liquid from the evaporator to the heat exchanger for heat absorption; and a return path that directs the refrigerant liquid from the heat exchanger for heat absorption to the evaporator, and the supply path is branched from the feed path at a position downstream of the pump. According to the second aspect, the supply path is branched from the feed path in which the temperature of the refrigerant circulating in the refrigeration cycle apparatus is lowest. Therefore, the heat-exchange efficiency of the intercooler is high.

A third aspect of the present disclosure provides the refrigeration cycle apparatus as set forth in the first aspect, wherein the evaporation-side circulation path includes: a feed path that is provided with a pump and that directs the refrigerant liquid from the evaporator to the heat exchanger for heat absorption; and a return path that directs the refrigerant liquid from the heat exchanger for heat absorption to the evaporator, and the supply path is branched from the return path. According to the third aspect, all of the refrigerant liquid flowing in the feed path passes through the heat exchanger for heat absorption. Therefore, the efficiency of the heat exchanger for heat absorption is high.

A fourth aspect of the present disclosure provides the refrigeration cycle apparatus as set forth in any one of the first to third aspects, wherein a supply-side flow rate adjustment valve that adjusts a flow rate of the refrigerant liquid flowing in the supply path is provided in the supply path, or a recovery-side flow rate adjustment valve that adjusts a flow rate of the refrigerant liquid flowing in the recovery path is provided in the recovery path. According to the fourth aspect, the flow rate of the refrigerant liquid supplied to the intercooler or the flow rate of the refrigerant liquid recovered from the intercooler can be adjusted based on the operating condition of the refrigeration cycle apparatus.

A fifth aspect of the present disclosure provides the refrigeration cycle apparatus as set forth in any one of the first to fourth aspects, wherein the intercooler is a heat exchanger that brings the refrigerant vapor compressed by the first compressor into contact with the refrigerant liquid to cool the refrigerant vapor. According to the fifth aspect, heat-transfer resistance between the refrigerant liquid and the refrigerant vapor is reduced by use of a direct contact heat exchanger. Therefore, the heat-exchange efficiency of the intercooler is improved. Consequently, heat-transfer area required for the intercooler to exhibit predetermined cooling performance is reduced, which allows size reduction of the intercooler.

A sixth aspect of the present disclosure provides the refrigeration cycle apparatus as set forth in the fifth aspect, wherein (i) the evaporation-side circulation path includes: a feed path that is provided with a pump and that directs the refrigerant liquid from the evaporator to the heat exchanger for heat absorption; and a return path that directs the refrigerant liquid from the heat exchanger for heat absorption to the evaporator, and the supply path is branched from the feed path at a position downstream of the pump, or (ii) the evaporation-side circulation path includes: a feed path that is provided with a pump and that directs the refrigerant liquid from the evaporator to the heat exchanger for heat absorption; and a return path that directs the refrigerant liquid from the heat exchanger for heat absorption to the evaporator, and the supply path is branched from the return path. According to the sixth aspect, the same effect as in the second aspect or the third aspect can be obtained in the fifth aspect.

A seventh aspect of the present disclosure provides the refrigeration cycle apparatus as set forth in the sixth aspect, wherein the refrigerant liquid is supplied to the intercooler through the supply path by power of the pump provided in the feed path, and the refrigerant liquid is recovered from the intercooler to the evaporator through the recovery path by means of a difference in pressure between the refrigerant vapor in the intercooler and the refrigerant vapor in the evaporator and by means of a difference in potential head between a liquid level in the intercooler and a liquid level in the evaporator. According to the fifth aspect, the power required for recovering the refrigerant liquid of the liquid pool of the intercooler to the evaporator can be limited only to a power for the pump provided in the feed path.

An eighth aspect of the present disclosure provides the refrigeration cycle apparatus as set forth in any one of the fifth to seventh aspects, wherein a supply-side flow rate adjustment valve that adjusts a flow rate of the refrigerant liquid flowing in the supply path is provided in the supply path. According to the eighth aspect, the amount of the refrigerant liquid flowing in the supply path can be adjusted.

A ninth aspect of the present disclosure provides the refrigeration cycle apparatus as set forth in the eighth aspect, wherein the supply-side flow rate adjustment valve is controlled so that the refrigerant vapor in the intercooler does not have a temperature lower than a saturated temperature. According to the eighth aspect, condensation of the refrigerant vapor in the intercooler can be prevented.

A tenth aspect of the present disclosure provides the refrigeration cycle apparatus as set forth in any one of the fifth to ninth aspects, wherein a recovery-side flow rate adjustment valve that adjusts a flow rate of the refrigerant liquid flowing in the recovery path is provided in the recovery path. According to the tenth aspect, the amount of the refrigerant flowing in the recovery path can be adjusted.

An eleventh aspect of the present disclosure provides the refrigeration cycle apparatus as set forth in the seventh aspect, further including: a supply-side flow rate adjustment valve that is provided in the supply path and adjusts a flow rate of the refrigerant liquid flowing in the supply path and a recovery-side flow rate adjustment valve that is provided in the recovery path and adjusts a flow rate of the refrigerant liquid flowing in the recovery path. According to the eleventh aspect, the stability of the refrigeration cycle apparatus can be enhanced.

A twelfth aspect of the present disclosure provides the refrigeration cycle apparatus as set forth in the tenth aspect or the eleventh aspect, wherein the recovery-side flow rate adjustment valve is controlled so that a liquid level in the intercooler is maintained within a predetermined range. According to the twelfth aspect, excessive change of not only the liquid level in the intercooler but also the liquid level in the evaporator can be suppressed.

A thirteenth aspect of the present disclosure provides the refrigeration cycle apparatus as set forth in any one of the fifth to twelfth aspects, wherein a downstream end of the recovery path is connected to the evaporator at a position lower than a liquid level in the evaporator. According to the twelfth aspect, the refrigerant vapor can be prevented from returning to the evaporator from the intercooler through the recovery path even when the liquid pool is lost from the intercooler.

A fourteenth aspect of the present disclosure provides the refrigeration cycle apparatus as set forth in any one of the fifth to thirteenth aspects, wherein the intercooler is a packed bed type heat exchanger or a spray type heat exchanger.

A fifteenth aspect of the present disclosure provides the refrigeration cycle apparatus as set forth in any one of the first to fourth aspects, wherein the intercooler is an indirect heat exchanger. According to the fifteenth aspect, the degree of cooling of the refrigerant vapor in the intercooler can be controlled accurately.

Hereinafter, embodiments of the present disclosure will be described with reference to the drawings. However, the present invention is not limited by the embodiments described below.

A refrigeration cycle apparatus 1A according to one embodiment of the present invention is shown in FIG. 1. The refrigeration cycle apparatus 1A includes: a main circuit 2 that allows a refrigerant to circulate; a first circulation path (evaporation-side circulation path) 5 for heat absorption; a second circulation path (condensation-side circulation path) 3 for heat release; and a controller 9. The inside of each of the main circuit 2, the first circulation path 5, and the second circulation path 3 is filled with a refrigerant whose main component is water or an alcohol, and the pressure in each of the main circuit 2, the second circulation path 3, and the first circulation path 5 is a negative pressure lower than an atmospheric pressure. The refrigerant that can be used is a refrigerant whose saturated vapor pressure is a negative pressure (a pressure that is lower than an atmospheric pressure in terms of absolute pressure) at ordinary temperature, such as a refrigerant containing water, an alcohol, or an ether as a main component.

The main circuit 2 includes an evaporator 25, a first compressor 21, an intercooler 8, a second compressor 22, a condenser 23, and an expansion valve 24, and these devices are connected in this order by flow paths. That is, the refrigerant circulating in the main circuit 2 passes through the evaporator 25, the first compressor 21, the intercooler 8, the second compressor 22, the condenser 23, and the expansion valve 24 in this order.

The evaporator 25 retains a refrigerant liquid, and evaporates the refrigerant liquid therein. Specifically, the refrigerant liquid retained in the evaporator 25 is circulated via a heat exchanger for heat absorption 6 by the first circulation path 5. In the evaporator 25, the refrigerant liquid having been heated in the heat exchanger for heat absorption 6 and having returned to the evaporator 25 from the downstream end of the first circulation path 5 is boiled under a reduced pressure. The refrigerant liquid to be returned to the evaporator 25 may be sprayed from the downstream end of the first circulation path 5.

The first circulation path 5 includes: a first feed path 51 that directs the refrigerant liquid from the evaporator 25 to the heat exchanger for heat absorption 6 and that is provided with a first pump 53 that pumps out the refrigerant liquid; and a first return path 52 that directs the refrigerant liquid from the heat exchanger for heat absorption 6 to the evaporator 25. For example, in the case where the refrigeration cycle apparatus 1A is an air conditioner for cooling an indoor space, the heat exchanger for heat absorption 6 is placed in the indoor space, and allows the indoor air supplied by an air blower 61 to be cooled through heat exchange with the refrigerant liquid. The first pump 53 is disposed at such a position that the height from the suction port of the pump to the liquid level in the evaporator 25 is larger than a required net positive suction head (required NPSH).

The refrigerant vapor is compressed in two stages by the first compressor 21 and the second compressor 22. The first compressor 21 and the second compressor 22 may each be a positive-displacement compressor or a centrifugal compressor. The temperature of the refrigerant vapor discharged from the first compressor 21 is, for example, 140° C., and the temperature of the refrigerant vapor discharged from the second compressor 22 is, for example, 170° C., The intercooler 8 cools the refrigerant vapor discharged from the first compressor 21 before the refrigerant vapor is drawn into the second compressor 22. The configuration of the intercooler 8 will be described in detail later.

The condenser 23 condenses the refrigerant vapor therein, and retains the refrigerant liquid. Specifically, the refrigerant liquid retained in the condenser 23 is circulated via a heat exchanger for heat absorption 4 by the second circulation path 3. In the condenser 23, the refrigerant vapor discharged from the second compressor 22 is condensed by direct contact with the refrigerant liquid having been cooled in the heat exchanger for heat absorption 4 and having returned to the condenser 23 from the downstream end of the second circulation path 3. The refrigerant liquid to be returned to the condenser 23 may be sprayed from the downstream end of the second circulation path 3.

The second circulation path 3 includes: a second feed path 31 that directs the refrigerant liquid from the condenser 23 to the heat exchanger for heat release 4 and that is provided with a second pump 33 that pumps out the refrigerant liquid; and a second return path 32 that directs the refrigerant liquid from the heat exchanger for heat release 4 to the condenser 23. For example, in the case where the refrigeration cycle apparatus 1A is an air conditioner for cooling an indoor space, the heat exchanger for heat absorption 4 is placed outside the indoor space, and allows outdoor air supplied by an air blower 41 to be heated through heat exchange with the refrigerant liquid. The second pump 33 is disposed at such a position that the height from the suction port of the pump to the liquid level in the condenser 23 is larger than a required net positive suction head (required NPSH).

The refrigeration cycle apparatus 1A need not necessarily be an air conditioner specialized for cooling. For example, when a first heat exchanger placed in an indoor space and a second heat exchanger placed outside the indoor space are connected to the evaporator 25 and the condenser 23 via four-way valves, an air conditioner capable of switching between cooling operation and heating operation can be obtained. In this case, both the first heat exchanger and the second heat exchanger function as the heat exchanger for heat absorption 6 and the heat exchanger for heat release 4. In addition, the refrigeration cycle apparatus 1A need not necessarily be an air conditioner, and may be, for example, a chiller. Furthermore, the object to be cooled in the heat exchanger for heat absorption 6 and the object to be heated in the heat exchanger for heat release 4 may be a gas other than air or a liquid. In other words, the types of the heat exchanger for heat release 4 and the heat exchanger for heat absorption 6 are not particularly limited as long as they are indirect heat exchangers.

The expansion valve 24 is one example of a pressure-reducing mechanism that reduces the pressure of the refrigerant liquid resulting from condensation. The expansion valve 24 is controlled by the controller 9. For example, the temperature of the refrigerant liquid whose pressure has been reduced is 10° C. The expansion valve 24 need not be provided as the pressure-reducing mechanism in the main circuit 2, and, for example, a configuration in which the level of the refrigerant liquid in the evaporator 25 is higher than the level of the refrigerant liquid in the condenser 23 may be employed.

Next, the configuration of the intercooler 8 will be described in detail.

The intercooler 8 is a heat exchanger that allows the refrigerant vapor compressed by the first compressor 21 to be cooled by the refrigerant liquid drawn from the first circulation path 5. For example, the intercooler 8 is a direct contact heat exchanger that brings the refrigerant vapor compressed by the first compressor 21 into direct contact with the refrigerant, liquid drawn from the first circulation path 5 and that thereby cools the refrigerant vapor. Alternatively, the intercooler 8 may be an indirect heat exchanger such as a shell-and-tube heat exchanger. When a direct contact method is employed as a method for cooing in the intercooler 8, the size of the intercooler 8 can be significantly reduced compared to when an indirect heat exchange method is used.

Figure 2:
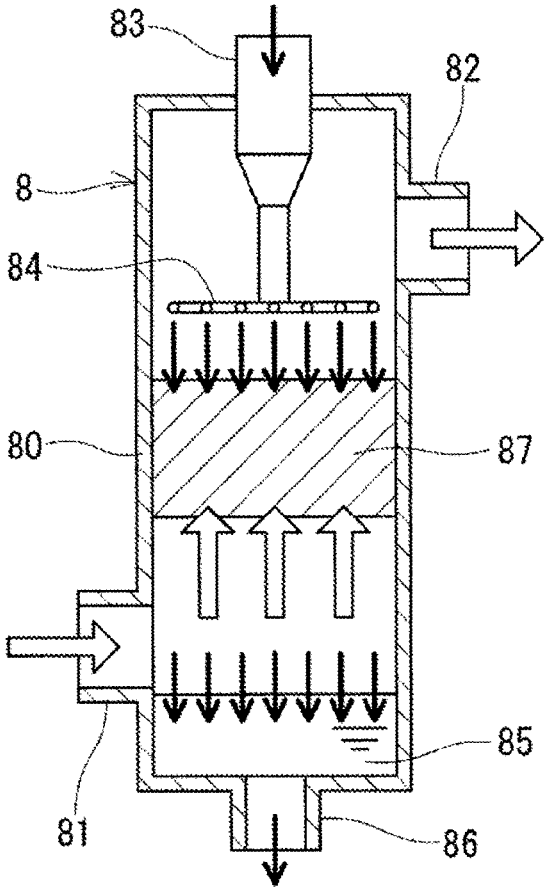
FIG. 2 is a cross-sectional view of an intercooler.

In the present embodiment, the intercooler 8 is a direct contact heat exchanger. Specifically, the intercooler 8 is a packed bed type heat exchanger as shown in FIG. 2. More specifically, the intercooler 8 has a container 80 that is cylindrical and extends vertically, and a packed bed 87 disposed in the container 80. A disperser 84 that emits and disperses the refrigerant liquid is disposed above the packed bed 87, and a liquid inlet tube 83 penetrating through the top wall of the container 80 is connected to the disperser 84. In a lower portion of the container 80, a liquid pool 85 is formed by the refrigerant liquid generated as a result of cooling of the refrigerant vapor, and a liquid outlet 88 for discharging the refrigerant liquid of the liquid pool 85 is provided in the bottom wall of the container 80. A vapor inlet 81 connected to the first compressor 21 via a flow path is provided in a lower portion of the side wall of the container 80, while a vapor outlet 82 connected to the second compressor 22 via a flow path is provided in an upper portion of the side wall. The intercooler 8 may be a spray type heat exchanger having a configuration obtained by omitting the packed bed 87 from the configuration shown in FIG. 2 and by disposing a spray instead of the disperser 84.

Referring hack to FIG. 1, the refrigeration cycle apparatus 1A is provided with: a supply path 71 that supplies, to the intercooler 8, a portion of the refrigerant liquid flowing in the first circulation path 5; and a recovery path 73 that recovers the refrigerant liquid from the intercooler 8 to the evaporator 25. In the present embodiment, the supply path 71 is branched from the first feed path 51 at a position downstream of the first pump 53.

The downstream end of the supply path 71 is connected to the liquid inlet tube 83 described above, and the upstream end of the recovery path 73 is connected to the liquid outlet 86 described above. The downstream end of the recovery path 73 is preferably connected to the evaporator 25 at a position lower than the liquid level in the evaporator 25. With this configuration, it is possible to prevent the refrigerant vapor from returning to the evaporator 25 from the intercooler 8 through the recovery path 73 even when the liquid pool 85 is lost from the intercooler 8.

The refrigerant liquid is supplied to the intercooler 8 through the supply path 71 by the power of the first pump 53 provided in the first feed path 51. That is, the first pump 53 pushes the refrigerant liquid out from the downstream end of the supply path 71 against the differential pressure between the inside of the intercooler 8 and the inside of the evaporator 25.

The refrigerant liquid is recovered to the evaporator 25 from the intercooler 8 through the recovery path 73 by means of the difference in pressure between the refrigerant vapor in the intercooler 8 and the refrigerant vapor in the evaporator and by means of the difference in potential head between the liquid level in the intercooler 8 and the liquid level in the evaporator 25. For this purpose, the vapor inlet 81 of the intercooler 8 is preferably located higher than the liquid level in the evaporator 25. This is also in order to ensure that the vapor inlet 81 of the intercooler 8 is prevented from being submerged in the liquid pool 85 even if the liquid level in the intercooler 8 is elevated up to the same level as the liquid level in the evaporator 25 while the refrigeration cycle apparatus 1A is not in operation.

In the present embodiment, a first flow rate adjustment valve (supply-side flow rate adjustment valve) 72 that adjusts the flow rate of the refrigerant liquid flowing in the supply path 71 is provided in the supply path 71, and a second flow rate adjustment valve (recovery-side flow rate adjustment valve) 74 that adjusts the flow rate of the refrigerant liquid flowing in the recovery path 73 is provided in the recovery path 73. The first flow rate adjustment valve 72 may be omitted, and the flow rate of the refrigerant liquid flowing in the supply path 71 may be adjusted by the first pump 53. In this case, however, since the ratio between the flow rate of the refrigerant liquid flowing in the supply path 71 and the flow rate of the refrigerant liquid flowing in the first circulation path 5 is fixed, operating points of the system are restricted compared to a configuration including the first flow rate adjustment valve 72. In addition, the second flow rate adjustment valve 74 may be omitted depending on, for example, the variation range of the volume of the liquid pool 85 of the intercooler 8.

The number of revolutions of the first pump 53 varies depending on the operating condition of the refrigeration cycle apparatus 1A. The variation in the number of revolutions of the first pump 53 influences the flow rate of the refrigerant liquid flowing in the supply path 71. Therefore, in order to adjust the flow rate of the refrigerant liquid in the supply path 71 in response to the variation in the number of revolutions of the first pump 53, the first flow rate adjustment valve 72 is desirably provided in the supply path 71. In addition, the difference between the pressure of the refrigerant vapor inside the intercooler 8 and the pressure of the refrigerant vapor inside the evaporator 25 varies depending on, for example, the operating condition of the refrigeration cycle apparatus 1A. In order to adjust the flow rate of the refrigerant liquid flowing in the recovery path 73 in response to the variation in the pressure difference, the second flow rate adjustment valve 74 is desirably provided in the recovery path 73. That is, in order to increase the stability of the system against the variation in the operating condition of the refrigeration cycle apparatus 1A, the refrigeration cycle apparatus 1A desirably includes both the first flow rate adjustment valve 72 and the second flow rate adjustment valve 74.

In the present embodiment, a route for recovering the refrigerant liquid having exchanged heat with the refrigerant vapor in the intercooler 8 is secured by providing the recovery path 73. Therefore, even when the accuracy of the flow rate adjustment by the first flow rate adjustment valve 72 is low, insufficiency or overflow of the refrigerant liquid supplied to the intercooler 8 can be avoided. Accordingly, an inexpensive valve can be used as the first flow rate adjustment valve 72.

The first flow rate adjustment valve 72 is controlled by the controller 9 so that the refrigerant vapor in the intercooler 8 is sufficiently cooled to the extent that the temperature of the refrigerant vapor does not decrease below the saturated temperature. For example, a temperature sensor may be provided in the intercooler 8 or in a flow path between the intercooler 8 and the second compressor 22, and the first flow rate adjustment valve 72 may be controlled based on the detection value of the temperature sensor.

In the intercooler 8, the refrigerant vapor is preferably cooled only by sensible heat exchange. In this case, the flow rate of the refrigerant vapor discharged from the first compressor 21 is equal to the flow rate of the refrigerant vapor drawn into the second compressor 22, which makes the control easy. For this purpose, the first flow rate adjustment valve 72 only needs to be controlled so as to secure a sufficient flow rate of the refrigerant liquid for preventing the refrigerant liquid from being heated to the saturated temperature as a result of heat exchange with the refrigerant vapor. Alternatively, all of the refrigerant liquid supplied from the supply path 71 may be evaporated in the intercooler 8.

The second flow rate adjustment valve 74 is controlled by the controller 9 so that the liquid level in the intercooler 8 is maintained within a predetermined range. This makes it possible to prevent excessive change of not only the liquid level in the intercooler 8 but also the liquid level in the evaporator 25. In order to avoid clogging of the vapor inlet 81 and to avoid generation of gas pocket in the flow path through which the refrigerant vapor flows, the liquid level in the intercooler 8 is preferably maintained lower than the vapor inlet 81 and higher than the bottom wall of the container 80. With this configuration, since the volume required for the liquid pool 85 (the height from the bottom wall of the container 80 to the vapor inlet 81) is reduced, the size of the container 80 can be reduced. For example, in the case where the refrigerant vapor is cooled only by sensible heat exchange, the opening degree of the second flow rate adjustment valve 74 only needs to be changed by the same amount as the change in the opening degree of the first rate adjustment valve 72.

Next, the operational process of the refrigeration cycle apparatus 1A will be described.

A refrigerant vapor compressed by the first compressor 21 is cooled in the intercooler 8 by a low-temperature refrigerant liquid supplied from the evaporator 25 through the upstream section of the first feed path 51 and the supply path 71, and is then drawn into the second compressor 22. The refrigerant vapor further compressed by the second compressor 22 is condensed in the condenser 23 by heat exchange with a refrigerant liquid supercooled in the first heat exchanger 4. A portion of the refrigerant liquid resulting from condensation in the condenser 23 is pumped out to the heat exchanger for heat release 4 by the second pump 33, and releases heat to air or another fluid. The remaining portion of the refrigerant liquid resulting from condensation in the condenser 23 is introduced into the evaporator 25 via the expansion valve 24. The opening degree of the expansion valve 24 is controlled, for example, based on the pressure of the refrigerant vapor discharged from the second compressor 22. That is, when the pressure of the refrigerant vapor discharged from the second compressor 22 is higher than a predetermined value, control for increasing the opening degree of the expansion valve 24 is performed. A portion of the refrigerant liquid in the evaporator 25 is pumped out by the first pump 53 to the heat exchanger for heat absorption 6, absorbs heat from air or another fluid, and then returns to the evaporator 25. The refrigerant liquid in the evaporator 25 is evaporated by being boiled under a reduced pressure, and the refrigerant vapor resulting from the evaporation is drawn into the first compressor 21.

A portion of the refrigerant liquid flowing in the first circulation path 5 is pumped out by the first pump 53 to the intercooler 8 through the supply path 71. The amount of the refrigerant liquid flowing in the supply path 71 is set by the first flow rate adjustment valve 72. Since the refrigerant vapor is cooled in the intercooler 8 before drawn into the second compressor 22, the amount of scale attached to the second compressor 22 can be reduced in the case where the refrigerant contains impurities. In addition, the temperature of the refrigerant vapor drawn into the second compressor 22 can be lowered. Consequently, the reliability of the second compressor 22 can be improved.

The refrigerant circulating in the refrigeration cycle apparatus 1A has a relatively low temperature when flowing in the first circulation path (evaporation-side circulation path), and the low-temperature refrigerant liquid flowing in the first circulation path is supplied to the intercooler 8. Since the temperature difference between the refrigerant vapor and the heat medium for cooling is large, the heat-exchange efficiency of the intercooler 8 is high.

In addition, in the refrigeration cycle apparatus 1A, a direct contact heat exchanger is used as the intercooler 8 for cooling the refrigerant vapor. Therefore, the amount of heat exchanged per unit heat-transfer area is increased, and the size of the intercooler 8 can be significantly reduced, compared to when an indirect heat exchanger is used. This is because, in the case of an indirect heat exchanger, an enormous heat-transfer resistance is caused at an interface between a refrigerant vapor and a heat transfer member separating a heat medium for cooling from the refrigerant vapor, while in the case of a direct contact heat exchanger, such heat-transfer resistance is not caused. Furthermore, in the refrigeration cycle apparatus 1A of the present embodiment, the refrigerant liquid circulating in the refrigeration cycle apparatus 1A can be used to achieve cooling of the refrigerant vapor in the intercooler 8. Therefore, it is possible to prevent the variation in refrigerant amount which is caused in the case where water for cooling is introduced into a refrigeration cycle apparatus from outside.

In addition, the refrigerant vapor is cooled in the intercooler 8 using the refrigerant liquid drawn from the first feed path 51 in which the temperature of the refrigerant circulating in the system is lowest. Accordingly, the temperature difference between the refrigerant vapor and the heat medium for cooling is maximized. For example, in the case where a refrigerant vapor of 140° C. discharged from the first compressor 21 is cooled to 50° C. in the intercooler 8 using outdoor air of 35° C. (in the case where the intercooler 8 is an indirect heat exchanger), a LMTD (a logarithmic mean value of the temperature differences between the refrigerant vapor and the refrigerant liquid in the inlet and outlet of the heat exchanger), which is an indicator of the temperature difference, has a value of 32.4° C. By contrast, in the refrigeration cycle apparatus 1A of the present embodiment, the value of the LMTD is increased to 74.4° C. since a refrigerant liquid of 10° C. can be used for cooling. By thus maximizing the temperature difference between the refrigerant vapor and the heat medium for cooling, further improvement in heat-exchange efficiency can be achieved (it should be noted that the two values of the LMTD are those calculated on the assumption that the refrigerant is water, and the mass ratio between the refrigerant vapor and the heat medium for cooling is 3:50).

In addition, in the recovery path 73, the refrigerant liquid is pumped out by means of the difference in pressure between the refrigerant vapor in the intercooler 8 and the refrigerant vapor in the evaporator 25 and by means of the difference in potential head between the liquid level in the intercooler 8 and the liquid level in the evaporator 25.

Therefore, the drive power required for cooling the refrigerant vapor in the course of compression process can be limited only to a power for the first pump 53 for pumping out the refrigerant liquid through the supply path 71. In addition, the power required for recovering the refrigerant liquid of the liquid pool 85 of the intercooler 8 to the evaporator 25 can be limited only to a power for the first pump 53 provided in the feed path 51.

<Modification>

Various modifications can be made to the refrigeration cycle apparatus 1A of the previously-described embodiment.

For example, the upstream end of the supply path 71 may be connected to the first circulation path 5 at any position as long as the position is located downstream of the first pump 53. That is, as in a refrigeration cycle apparatus 1B shown in FIG. 3 as an example of modification, the supply path 71 may be branched from the first return path 52.

Figure 3:
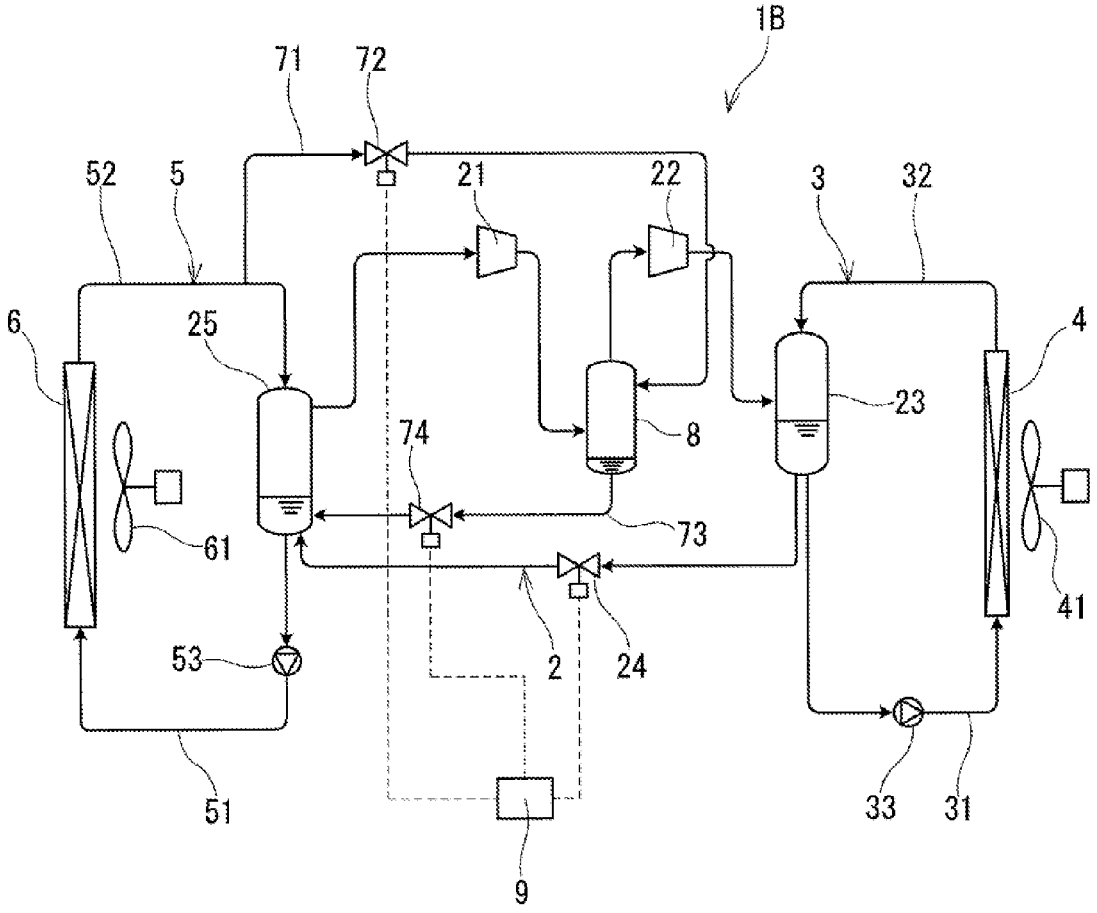
FIG. 3 is a configuration diagram of a refrigeration cycle apparatus according to an example of modification.

In the case where the supply path 71 is branched from the first return path 52 as shown in FIG. 3, the temperature of the refrigerant liquid supplied to the intercooler 8 is higher than in the case where the supply path 71 is branched from the first feed path 51 (in the case of the refrigeration cycle apparatus 1A of the previously-described embodiment). Consequently, in the refrigeration cycle apparatus 1B which is an example of modification, the temperature difference between the refrigerant vapor and the refrigerant liquid in the intercooler 8 is smaller than that in the refrigeration cycle apparatus 1A of the previously-described embodiment, and the size of the intercooler 8 is increased. However, since all of the refrigerant liquid flowing in the first feed path 51 passes through the heat exchanger for heat absorption 6, the efficiency of the heat exchanger for heat absorption 6 is somewhat higher in the refrigeration cycle apparatus 1B than in the refrigeration cycle apparatus 1A.

When the refrigeration cycle apparatus 1A of the previously-described embodiment and the refrigeration cycle apparatus 1B which is an example of modification are compared, there is no difference in the heat flow in the whole system. That is, the position of the upstream end of the supply path 71 does not have great influence on the system efficiency itself. However, the most preferred embodiment is determined based on which of the efficiency improvement and size reduction of the intercooler 8 and the efficiency improvement and size reduction of the heat exchanger for heat absorption 6 generates higher added value from the standpoint of the configuration of the system.

Figure 4:
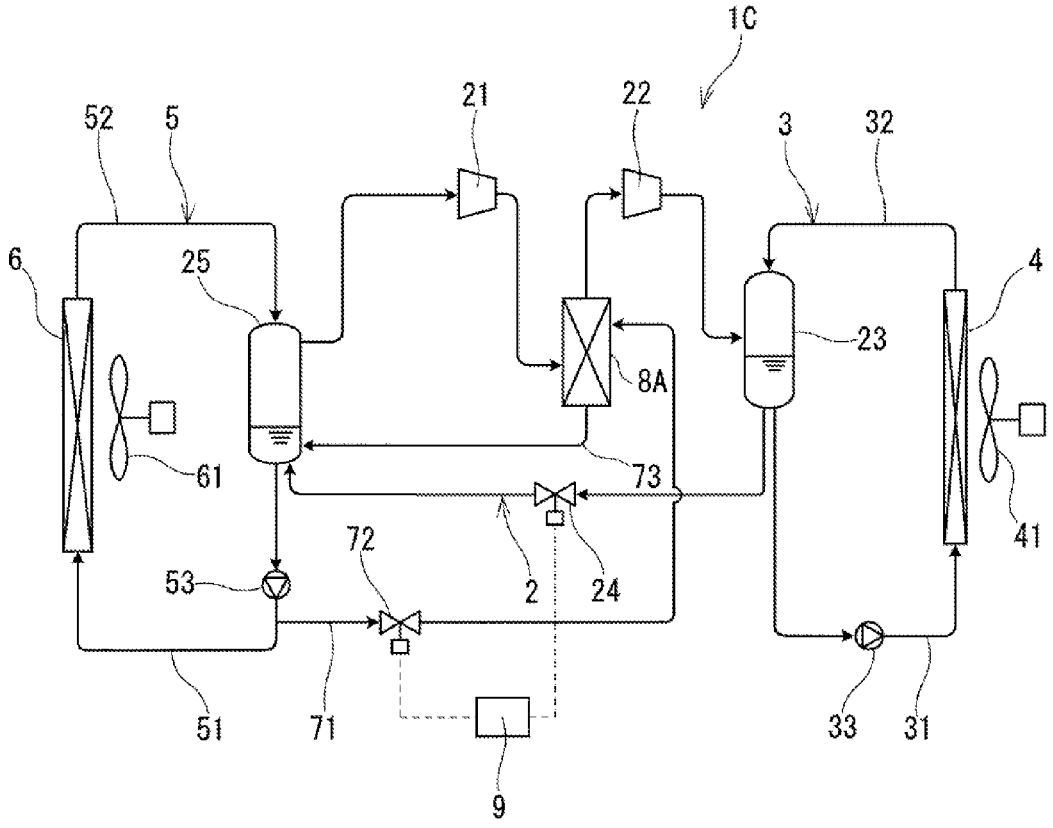
FIG. 4 is a configuration diagram of a refrigeration cycle apparatus according to another example of modification.

The refrigeration cycle apparatus 1A may be modified to a refrigeration cycle apparatus 1C shown in FIG. 4. In the present example of modification, the components that are the same as or correspond to those of the refrigeration cycle apparatus 1A are denoted by the same reference characters. The refrigeration cycle apparatus 1C is different from the refrigeration cycle apparatus 1A in that an intercooler 8A that is an indirect heat exchanger is provided instead of the intercooler 8 that is a direct contact heat exchanger. The intercooler 8A is, for example, a shell-and-tube heat exchanger. A refrigerant vapor compressed by the first compressor 21 flows through a space between the shell and the tube of the intercooler 8A, while a refrigerant liquid supplied from the supply path 71 flows through the inside of the tube of the intercooler 8A. In this manner, heat exchange takes place between the refrigerant vapor and the refrigerant liquid. With this configuration, the degree of cooling of the refrigerant vapor in the intercooler 8A can be controlled accurately. Therefore, the refrigerant vapor can be prevented from being excessively cooled and thus being condensed in the intercooler 8A. According to the present example of modification, in order to adjust the flow rate of the refrigerant, liquid in the supply path 71 and the flow rate of the refrigerant liquid in the recovery path 73, the refrigeration cycle apparatus 1C only needs to be provided with either the first flow rate adjustment valve 72 or the second flow rate adjustment valve 74. Furthermore, the refrigeration cycle apparatus 1C may be modified in such a manner that the supply path 71 is branched from the first return path 52 as shown in FIG. 3.

In addition, the condenser 23 need not necessarily be a direct contact heat exchanger, and may be an indirect heat exchanger. In this case, the heat medium heated by the refrigerant vapor in the condenser 23 circulates in the second circulation path 3.

INDUSTRIAL APPLICABILITY

The refrigeration cycle apparatus of the present invention is useful particularly for household air conditioners, industrial air conditioners, etc.

The invention claimed is:

1. A refrigeration cycle apparatus comprising:

a main circuit that allows a refrigerant whose saturated vapor pressure is a negative pressure at ordinary temperature to circulate, the main circuit comprising an evaporator that retains a refrigerant liquid and that evaporates the refrigerant liquid therein, a first compressor that compresses a refrigerant vapor, an intercooler that cools the refrigerant vapor, a second compressor that compresses the refrigerant vapor, and a condenser that condenses the refrigerant vapor therein and that retains the refrigerant liquid, wherein the evaporator, the first compressor, the intercooler, the second compressor, and the condenser are connected in this order with respect to refrigerant flow in the main circuit; and an evaporation-side circulation path that allows the refrigerant liquid retained in the evaporator to circulate via a heat exchanger for heat absorption, wherein the intercooler is a heat exchanger that allows the refrigerant vapor compressed by the first compressor to be cooled by the refrigerant liquid, and the refrigerant vapor flows from the first compressor to the intercooler to be cooled, before flowing to the second compressor, and the refrigeration cycle apparatus further comprises: a supply path that supplies a portion of the refrigerant liquid flowing in the evaporation-side circulation path to the intercooler without going through the condenser; and a recovery path that recovers the refrigerant liquid from the intercooler to the evaporator.

2. The refrigeration cycle apparatus according to claim 1, wherein the evaporation-side circulation path comprises: a feed path that is provided with a pump and that directs the refrigerant liquid from the evaporator to the heat exchanger for heat absorption; and a return path that directs the refrigerant liquid from the heat exchanger for heat absorption to the evaporator, and the supply path is branched from the feed path at a position downstream of the pump.

3. The refrigeration cycle apparatus according to claim 1, wherein the evaporation-side circulation path comprises: a feed path that is provided with a pump and that directs the refrigerant liquid from the evaporator to the heat exchanger for heat absorption; and a return path that directs the refrigerant liquid from the heat exchanger for heat absorption to the evaporator, and the supply path is branched from the return path.

4. The refrigeration cycle apparatus according to claim 1, wherein a supply-side flow rate adjustment valve that adjusts a flow rate of the refrigerant liquid flowing in the supply path is provided in the supply path, or a recovery-side flow rate adjustment valve that adjusts a flow rate of the refrigerant liquid flowing in the recovery path is provided in the recovery path.

5. The refrigeration cycle apparatus according to claim 1, wherein the intercooler is a heat exchanger that brings the refrigerant vapor compressed by the first compressor into contact with the refrigerant liquid to cool the refrigerant vapor.

6. The refrigeration cycle apparatus according to claim 5, wherein (i) the evaporation-side circulation path comprises: a feed path that is provided with a pump and that directs the refrigerant liquid from the evaporator to the heat exchanger for heat absorption; and a return path that directs the refrigerant liquid from the heat exchanger for heat absorption to the evaporator, and the supply path is branched from the feed path at a position downstream of the pump, or (ii) the evaporation-side circulation path comprises: a feed path that is provided with a pump and that directs the refrigerant liquid from the evaporator to the heat exchanger for heat absorption; and a return path that directs the refrigerant liquid from the heat exchanger for heat absorption to the evaporator, and the supply path is branched from the return path.

7. The refrigeration cycle apparatus according to claim 6, wherein the refrigerant liquid is supplied to the intercooler through the supply path by power of the pump provided in the feed path, and the refrigerant liquid is recovered from the intercooler to the evaporator through the recovery path by means of a difference in pressure between the refrigerant vapor in the intercooler and the refrigerant vapor in the evaporator and by means of a difference in potential head between a liquid level in the intercooler and a liquid level in the evaporator.

8. The refrigeration cycle apparatus according to claim 5, wherein a supply-side flow rate adjustment valve that adjusts a flow rate of the refrigerant liquid flowing in the supply path is provided in the supply path.

9. The refrigeration cycle apparatus according to claim 8, wherein the supply-side flow rate adjustment valve is controlled so that the refrigerant vapor in the intercooler does not have a temperature lower than a saturated temperature.

10. The refrigeration cycle apparatus according to claim 5, wherein a recovery-side flow rate adjustment valve that adjusts a flow rate of the refrigerant liquid flowing in the recovery path is provided in the recovery path.

11. The refrigeration cycle apparatus according to claim 7, further comprising: a supply-side flow rate adjustment valve that is provided in the supply path and adjusts a flow rate of the refrigerant liquid flowing in the supply path; and a recovery-side flow rate adjustment valve that is provided in the recovery path and adjusts a flow rate of the refrigerant liquid flowing in the recovery path.

12. The refrigeration cycle apparatus according to claim 10, wherein the recovery-side flow rate adjustment valve is controlled so that a liquid level in the intercooler is maintained within a predetermined range.

13. The refrigeration cycle apparatus according to claim 5, wherein a downstream end of the recovery path is connected to the evaporator at a position lower than a liquid level in the evaporator.

14. The refrigeration cycle apparatus according to claim 5, wherein the intercooler is a packed bed type heat exchanger or a spray type heat exchanger.

15. The refrigeration cycle apparatus according to claim 1, wherein the intercooler is an indirect heat exchanger.

16. The refrigeration cycle apparatus according to claim 1, wherein the main circuit constitutes a loop, and the evaporator, the first compressor, the intercooler, the second compressor, and the condenser are present in the loop in this order with respect to refrigerant flow in the main circuit.

* * * * *